US012624298B2

(12) United States Patent
Marques et al.

(10) Patent No.: US 12,624,298 B2
(45) **Date of Patent: *May 12, 2026**

(54) ENTRAINED-BED HYDROCONVERSION OF A HEAVY HYDROCARBON FEEDSTOCK, COMPRISING PRE-MIXING SAID FEEDSTOCK WITH AN ORGANIC ADDITIVE

(71) Applicant: IFP ENERGIES NOUVELLES, Rueil-Malmaison (FR)

(72) Inventors: Joao Marques, Rueil-Malmaison Cedex (FR); Thibaut Corre, Rueil-Malmaison Cedex (FR); Jeremie Barbier, Rueil-Malmaison Cedex (FR); Brett Matthew Silverman, Lawrenceville, NJ (US); David M. Mountainland, Lawrenceville, NJ (US); Sukesh Parasher, Lawrenceville, NJ (US)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 171 days.

This patent is subject to a terminal disclaimer.

(21) Appl. No.: 18/576,773

(22) PCT Filed: Jun. 27, 2022

(86) PCT No.: PCT/EP2022/067624
§ 371 (c)(1),
(2) Date: Jan. 5, 2024

(87) PCT Pub. No.: WO2023/280625
PCT Pub. Date: Jan. 12, 2023

(65) Prior Publication Data

US 2024/0309279 A1 Sep. 19, 2024

(30) Foreign Application Priority Data

Jul. 8, 2021 (FR) ..... 2107376

(51) Int. Cl.
*C10G 45/16* (2006.01)
*C10G 45/04* (2006.01)

(52) U.S. Cl.
CPC ..... *C10G 45/16* (2013.01); *C10G 45/04* (2013.01); *C10G 2300/107* (2013.01); *C10G 2300/1074* (2013.01)

(58) Field of Classification Search
CPC .. C10G 45/16; C10G 45/04; C10G 2300/107; C10G 2300/1074; C10G 29/22; C10G 47/26; C10G 67/02
See application file for complete search history.

(56) References Cited

U.S. PATENT DOCUMENTS 3,231,488 A 1/1966 Gatsis et al.
4,244,839 A 1/1981 Aldridge et al.
(Continued)

FOREIGN PATENT DOCUMENTS

FR 3027909 A1 5/2016

OTHER PUBLICATIONS

International Search Report PCT/EP2022/067624 dated Sep. 6, 2022 (pp. 1-3).
(Continued)

*Primary Examiner* — Michelle Stein
(74) *Attorney, Agent, or Firm* — Millen, White, Zelano & Branigan, P.C.; Brion P. Heaney

(57) ABSTRACT

The present invention relates to a slurry hydroconversion process of a heavy oil feedstock comprising: (a) preparing a first conditioned feedstock (103) by blending said heavy oil feedstock (101) with an organic chemical compound (102) comprising at least one carboxylic acid function and/or at least one ester function and/or an acid anhydride function; (b) preparing a second conditioned feedstock (105) by mixing a catalyst precursor composition (104) with said first
(Continued)

conditioned feedstock so that a colloidal or molecular catalyst is formed when it reacts with sulfur; (c) heating the second conditioned feedstock in at least one preheating device; (d) introducing the heated second conditioned feedstock (106) into at least one slurry bed reactor and operating said slurry bed reactor in the presence of hydrogen and at hydroconversion conditions to produce an upgraded material (107), the colloidal or molecular catalyst being formed during step (c) and/or (d).

20 Claims, 3 Drawing Sheets

(56) References Cited

U.S. PATENT DOCUMENTS

| | | | | |
|---|---|---|---|---|
| 4,637,870 | A | 1/1987 | Bearden, Jr et al. | |
| 4,637,871 | A | 1/1987 | Bearden, Jr et al. | |
| 6,043,182 | A | 3/2000 | Cordova et al. | |
| 6,960,325 | B2 | 11/2005 | Kao et al. | |
| 8,431,016 | B2 | 4/2013 | Lott et al. | |
| 10,822,553 | B2 | 11/2020 | Lott | |
| 10,941,353 | B2 | 3/2021 | Lott | |
| 11,192,089 | B2 | 12/2021 | Corre et al. | |
| 2005/0241991 | A1 | 11/2005 | Lott et al. | |
| 2005/0241993 | A1* | 11/2005 | Lott | C10G 47/26 208/108 |
| 2007/0158238 | A1* | 7/2007 | Wu | B82Y 30/00 208/111.3 |
| 2010/0044277 | A1 | 2/2010 | Kuperman et al. | |
| 2014/0027344 | A1 | 1/2014 | Harris et al. | |
| 2019/0270074 | A1 | 9/2019 | Mathivet et al. | |

OTHER PUBLICATIONS

Kang Ki Hyuk et al: "A review on the Mo-precursors for catalytic hydroconversion of heavy oil", Journal of Industrial and Engineering Chemistry, vol. 76, 2019, pp. 1-16, XP085697399, ISSN: 1226-086X, DOI: 10.1016/J.JIEC.2019.03.022.

* cited by examiner

ENTRAINED-BED HYDROCONVERSION OF A HEAVY HYDROCARBON FEEDSTOCK, COMPRISING PRE-MIXING SAID FEEDSTOCK WITH AN ORGANIC ADDITIVE

TECHNICAL FIELD

The present invention relates to a process for converting heavy oil feedstocks in the presence of hydrogen, a colloidal or molecular catalyst, and an organic additive.

In particular, the present invention relates to a process for hydroconversion of heavy oil feedstocks containing a fraction of at least 50% by weight having a boiling point of at least 300° C., and especially heavy oil feedstocks including a significant quantity of asphaltenes and/or fractions boiling above 500° C., such as crude oils or heavy hydrocarbon fractions resulting from the atmospheric and/or vacuum distillation of a crude oil, to yield lower boiling, higher quality materials.

The process specifically comprises premixing said feedstock with an organic additive, before being brought into contact with the catalyst, said catalyst operating in one or several slurry bed reactors, in order to allow upgrading of this low-quality feedstock while minimizing fouling in equipment prior to hydroconversion in the slurry bed reactor (s).

PRIOR ART

Converting heavy oil feedstocks into useful end products requires extensive processing, including reducing the boiling point of the heavy oil, increasing the hydrogen-to-carbon ratio, and removing impurities such as metals, sulfur, nitrogen and high carbon forming compounds.

Catalytic hydroconversion is commonly used for heavy oil feedstocks and is generally carried out using three-phase reactors in which the feedstock is brought into contact with hydrogen and a catalyst. In the reactor, the catalyst can be used in the form of a fixed bed, a moving bed, an ebullated bed or an entrained bed, as for example described in chapter 18 "Catalytic Hydrotreatment and Hydroconversion: Fixed Bed, Moving Bed, Ebullated Bed and Entrained Bed" of the book "Heavy Crude Oils: From Geology to Upgrading, An Overview", published by Éditions Technip in 2011. In the case of an ebullated bed or an entrained bed, the reactor comprises an upflow of liquid and of gas. The choice of the technology generally depends on the nature of the feedstock to process, and in particular its metal content, its tolerance for impurities and the conversion targeted.

Slurry bed hydroconversion processes use entrained bed technologies, also known as slurry bed technologies. In such processes, a dispersed catalyst or catalyst precursor is injected on a continuous basis within the heavy oil feedstock in the slurry reactor, promoting hydrogenation of radicals formed by thermal cracking reactions, and limiting coke formation. The catalyst provides not only the catalytic activity but also a surface for the deposition of metals and asphaltenes from the feedstock. The catalyst of very small size, dispersed within the feedstock, is entrained out of the reactor with the effluents, since the catalyst and liquid heavy oil feedstock ac t like one homogeneous phase.

Slurry bed hydroconversion processes are known to generally aim at fully converting heavy oil feedstock into lighter fractions, using highly severe operating conditions (temperature, hydrogen partial pressure, residence time). Theoretical advantages of slurry bed processes reside in a much better hydrogenation, especially of the heaviest products, thanks to a better accessibility of the active sites, resulting in a higher conversion, improved product quality and higher product stability. Moreover, owing to the lower catalyst residence time, deactivation of the catalyst is greatly reduced. Regarding the stability of the products, it is known that during operation of slurry bed reactor for upgrading heavy oil, the heavy oil is heated to a temperature at which the high boiling fractions of the heavy oil feedstock typically having a high molecular weight and/or low hydrogen/carbon ratio, an example of which is a class of complex compounds collectively referred to as "asphaltenes", tend to undergo thermal cracking to form free radicals of reduced chain length. These free radicals have the potential of reacting with other free radicals, or with other molecules, to produce coke precursors and sediments. A slurry catalyst passing through the reactor reacts with the free radicals in these zones, forming stable molecules of reduced molecular weight and boiling point, and thus contributes to control and reduce the formation of sediments and coke precursors. As formation of coke and sediments is a major cause of hydroconversion equipment fouling, such a slurry process allows preventing the fouling of downstream equipment, such as separation vessels, distillation columns, heat exchangers etc.

Slurry catalysts for heavy oil hydroconversion, and in particular colloidal or molecular catalysts formed by the use of soluble catalytic precursors, are well known in the art. It is known in particular that certain metal compounds, such as organosoluble compounds (e.g. molybdenum naphthenate or molybdenum octoate as cited in U.S. Pat. No. 4,244,839, US2005/0241991, US2014/0027344) or water-soluble compounds (e.g. phosphomolybdic acid cited in U.S. Pat. Nos. 3,231,488, 4,637,870 and 4,637,871; ammonium heptamolybdate cited in U.S. Pat. No. 6,043,182, salts of a heteropolyanion as cited in FR3074699), can be used as dispersed catalyst precursors and form catalysts. In case of water-soluble compounds, the dispersed catalyst precursor is generally mixed with the feedstock to form an emulsion. The dissolving of the dispersed catalyst (in general molybdenum) precursor, optionally promoted by cobalt or nickel in acid medium (in the presence of $H_3PO_4$) or basic medium (in the presence of $NH_4OH$), has been the subject of many studies and patents.

Patent document U.S. Pat. No. 8,431,016 discloses a hydroconversion process for heavy oils using a colloidal or molecular catalyst in a slurry bed hydrocracking reactor. The addition of a dispersed organosoluble catalyst precursor, which is pre-diluted in vacuum gas oil (VGO), is carried out in an intimate mixing stage with the feedstock for preparing a conditioned feedstock prior to its introduction into the slurry bed reactor. The catalyst precursor, typically molybdenum 2-ethylhexanoate, forms a colloidal or molecular catalyst (e.g. dispersed molybdenum sulfide) when heated by reaction with the $H_2S$ originating from the hydrodesulfurization of the feedstock. A process of this kind inhibits the formation of coke precursors and sediments that might otherwise foul the ebullated bed reactor and downstream equipment, while providing conversion of the asphaltene fraction at essentially the same rate as the overall resid conversion rate, even at very high overall resid conversion rate, unlike hydroconversion processes using conventional supported catalysts.

In addition to fouling due to coke precursors and sediments that can occur in the slurry bed reactor and downstream equipment, the inventors have observed that fouling can also occur in equipment upstream, as soon as the heavy oil feedstock containing the catalyst precursor is heated before its introduction into the hydroconversion reactor.

Such a fouling in equipment upstream of the hydroconversion reactor, especially in the heating equipment of the heavy oil feedstock, mixed with the catalyst precursor of the particular colloidal or molecular catalyst, seems to be mainly related to metal and carbon build-up on walls, and can limit equipment operability.

Thus, although the slurry catalyst in known slurry processes such as described in document U.S. Pat. No. 8,431,016 is known to reduce coke precursors and sediments in the hydroconversion reactor and downstream equipment, fouling observed in upstream equipment containing the heavy oil feedstock mixed with the catalyst precursor, such as in a preheating device, constitutes another operational issue not solved so far. Also, it has been observed that fouling due to coke precursors and sediments can still occur in downstream equipment in some cases, showing that the performance of the addition of such a slurry catalyst can still be improved.

Objectives and Summary of the Invention

Within the context described above, an aim of the present invention is to provide a slurry hydroconversion process implementing a colloidal or molecular catalyst formed by the use of a soluble catalytic precursor, addressing the problem of fouling, especially in equipment upstream of the hydroconversion reactor, in particular in a preheating device of the feedstock prior to its conversion in the slurry hydroconversion reactor(s).

More generally, the present invention aims at providing a slurry hydroconversion process for upgrading of heavy oil feedstocks allowing one or more of the following effects: reduced equipment fouling, more effective processing of asphaltene molecules, reduction in the formation of coke precursors and sediments increased conversion level, enabling the reactor to process a wider range of lower quality feedstocks, elimination of catalyst-free zones in downstream processing equipment, longer operation in between maintenance shut downs, and increased throughput of heavy oil feedstock, and increased rate of production of converted products. Reducing the frequency of shutdown and startup of process vessels means less pressure and temperature cycling of process equipment, and this significantly increases the process safety and extends the useful life of expensive equipment.

Thus, in order to achieve at least one of the objectives targeted above, among others, the present invention provides, according to a first aspect, a process for the hydroconversion of a heavy oil feedstock containing a fraction of at least 50% by weight having a boiling point of at least 300° C., and containing metals and asphaltenes, comprising the following steps:

(a) preparing a first conditioned heavy oil feedstock by blending said heavy oil feedstock with an organic chemical compound comprising at least one carboxylic acid function and/or at least one ester function and/or an acid anhydride function;

(b) preparing a second conditioned heavy oil feedstock by mixing a catalyst precursor composition with the first conditioned heavy oil feedstock from step (a) in a manner so that a colloidal or molecular catalyst is formed when it reacts with sulfur;

(c) heating the second conditioned heavy oil feedstock from step (b) in at least one preheating device;

(d) introducing said heated second conditioned heavy oil feedstock from step (c) into at least one slurry bed reactor and operating said slurry bed reactor in the presence of hydrogen and at hydroconversion conditions to produce an upgraded material, and wherein the colloidal or molecular catalyst is formed in situ within the second conditioned heavy oil feedstock at step (c) and/or at step (d).

According to one or more embodiments, step (a) comprises mixing said organic chemical compound and said heavy oil feedstock in a dedicated vessel of an active mixing device.

According to one or more embodiments, step (a) comprises injecting said organic chemical compound into a pipe conveying said heavy oil feedstock toward the slurry bed reactor.

According to one or more embodiments, step (a) is carried out at a temperature between room temperature and 300° C., preferably between 70° C. and 200° C., and the residence time of the organic chemical compound with the heavy oil feedstock before step (b) is between 1 second and 10 hours.

According to one or more embodiments, the organic chemical compound is selected from the group consisting of 2-ethylhexanoic acid, naphthenic acid, caprylic acid, adipic acid, pimelic acid, suberic acid, azelaic acid, and sebacic acid, ethyl octanoate, ethyl 2-ethylhexanoate, 2-ethylhexyl 2-ethylhexanoate, benzyl 2-ethylhexanoate, diethyl adipate, dimethyl adipate, bis(2-ethylhexyl) adipate, dimethyl pimelate, dimethyl suberate, monomethyl suberate, hexanoic anhydride, caprylic anhydride, and a mixture thereof.

According to one or more embodiments, the organic chemical compound comprises 2-ethylhexanoic acid, and preferably is 2-ethylhexanoic acid.

According to one or more embodiments, the organic chemical compound comprises ethyl octanoate or 2-ethylhexyl 2-ethylhexanoate, and is preferably ethyl octanoate or 2-ethylhexyl 2-ethylhexanoate.

According to one or more embodiments, the catalyst precursor composition comprises an oil soluble organometallic or bimetallic compound or complex, preferably an oil soluble organo-metallic compound or complex selected from the group consisting of molybdenum 2-ethylhexanoate, molybdenum naphthanate, vanadium naphthanate, vanadium octoate, molybdenum hexacarbonyl, vanadium hexacarbonyl, and iron pentacarbonyl, and is preferably molybdenum 2-ethylhexanoate.

According to one or more embodiments, the molar ratio between said organic chemical compound added at step a) and the active metal(s), preferably molybdenum, of the catalyst precursor composition added at step (b) in said second conditioned heavy oil feedstock is comprised between 0.1:1 and 20:1.

According to one or more embodiments, the colloidal or molecular catalyst comprises molybdenum disulfide.

According to one or more embodiments, step (b) comprises (b1) pre-mixing the catalyst precursor composition with a hydrocarbon oil diluent below a temperature at which a substantial portion of the catalyst precursor composition begins to undergo thermal decomposition to form a diluted precursor mixture; and (b2) mixing said diluted precursor mixture with the first conditioned heavy oil feedstock.

According to one or more embodiments, step (b1) is carried out at a temperature comprised between room temperature and 300° C. and for a period of time from 1 second to 30 minutes, and step (b2) is carried out at a temperature between room temperature and 300° C. and for a period of time from 1 second to 30 minutes.

According to one or more embodiments, step (c) comprises heating at a temperature between 280° C. and 450° C., more preferably between 300° C. and 400° C., and even more preferably between 320° C. and 365° C.

According to one or more embodiments, the heavy oil feedstock comprises at least one of the following feedstocks: heavy crude oil, oil sand bitumen, atmospheric tower bottoms, vacuum tower bottoms, resid, visbreaker bottoms, coal tar, heavy oil from oil shale, liquefied coal, heavy bio oils, and heavy oils comprising plastic waste and/or a plastic pyrolysis oil.

According to one or more embodiments, the heavy oil feedstock has sulfur in a content of greater than 0.5% by weight, a Conradson carbon residue of at least 0.5% by weight, $C_7$ asphaltenes at a content of greater than 1% by weight, transition and/or post-transition and/or metalloid metals at a content of greater than 2 ppm by weight, and alkali and/or alkaline earth metals at a content of greater than 2 ppm by weight.

According to one or more embodiments, step (d) is carried out under an absolute pressure of between 2 MPa and 38 MPa, at a temperature of between 300° C. and 550° C., at an liquid hourly space velocity LHSV relative to the volume of each slurry bed reactor of between $0.05^{-1}$ and $10^{-1}$ and under an amount of hydrogen mixed with the feedstock entering slurry bed reactor of between 50 and 5000 $Nm^3/m^3$ of feedstock.

According to one or more embodiments, the concentration of metal of the catalyst, preferably molybdenum, in the second conditioned oil feedstock is preferably in a range of 10 ppm to 10000 ppm by weight of the heavy oil feedstock.

Other subjects and advantages of the invention will become apparent on reading the description which follows of specific exemplary embodiments of the invention, given by way of non-limiting examples, the description being made with reference to the appended figures described below.

DESCRIPTION OF THE EMBODIMENTS

Figure 1:
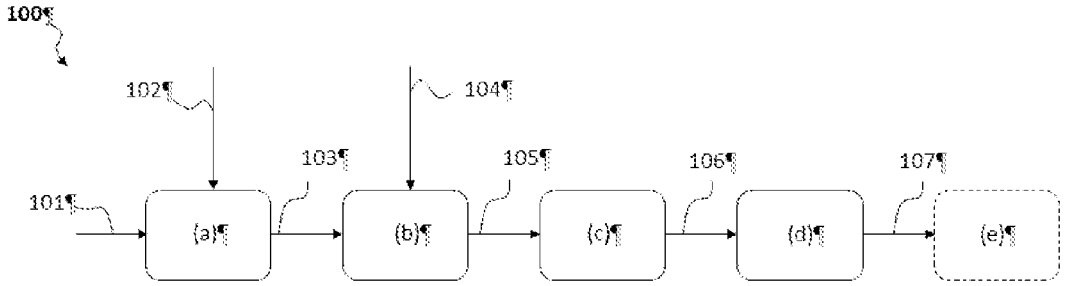
FIG. 1 is a block diagram illustrating the principle of the slurry bed hydroconversion process according to the invention.

The object of the invention is to provide slurry bed hydroconversion methods and systems for improving the quality of a heavy oil feedstock.

Such methods and systems employ a slurry catalyst being a molecularly or colloidally-dispersed hydroconversion catalyst. They also employ an organic additive mixed with the heavy oil feedstock, prior to using the slurry catalyst in one or more slurry bed reactors, each of which comprising a liquid phase comprising the heavy oil feedstock, the colloidal or molecular catalyst dispersed therein and the organic additive, and a gaseous phase comprising hydrogen gas.

The slurry bed hydroconversion methods and systems of the invention reduce equipment fouling, and especially fouling in equipment upstream the slurry hydroconversion reactor(s), in particular in preheating equipment of the feedstock prior to its conversion in the slurry hydroconversion reactor(s), and can effectively process asphaltenes, reduce or eliminate the formation of coke precursors and sediments, increase conversion level especially by allowing hydroconversion to be operated at high temperature, and eliminate catalyst-free zones that would otherwise exist in downstream processing equipment.

Terminology

Some definitions are given below, although more details on the objects hereafter defined shall be given further in the description.

The term "hydroconversion" shall refer to a process whose primary purpose is to reduce the boiling range of a heavy oil feedstock and in which a substantial portion of the feedstock is converted into products with boiling ranges lower than that of the original feedstock. Hydroconversion generally involves fragmentation of larger hydrocarbon molecules into smaller molecular fragments having a fewer number of carbon atoms and a higher hydrogen-to-carbon ratio. Reactions implemented during hydroconversion allow the size of hydrocarbon molecules to be reduced, mainly by cleavage of carbon-carbon bonds, in the presence of hydrogen in order to saturate the cut bonds and aromatic rings. The mechanism by which hydroconversion occurs typically involves the formation of hydrocarbon free radicals during fragmentation mainly by thermal cracking, followed by the capping of the free radical ends or moieties with hydrogen in the presence of active catalyst sites. Of course, during a hydroconversion process other reactions typically associated with "hydrotreating" can occur such as the removal of sulfur and nitrogen from the feedstock as well as olefin.

The term "hydrocracking" is often used as a synonym for "hydroconversion" according to the English terminology, although "hydrocracking" shall rather refer to a process similar to hydroconversion but in which cracking of hydrocarbon molecules is mainly a catalytic cracking, that is a cracking occurring in the presence of a hydrocracking catalyst having a phase responsible for the cracking activity, for example acidic sites as for example contained in clay or zeolites. According to the French terminology for example, hydrocracking which can be translated as "hydrocraquage" generally refers to this last definition (catalytic cracking), and its usage is for example rather reserved for the case of vacuum distillates as oil feedstocks to be converted, whereas the French term "hydroconversion" is generally reserved for the conversion of heavy oils feedstocks like atmospheric and vacuum residues (but not only).

The term "hydrotreating" shall refer to a milder operation whose primary purpose is to remove impurities such as sulfur, nitrogen, oxygen, halides, and trace metals from the feedstock and saturate olefins and/or stabilize hydrocarbon free radicals by reacting them with hydrogen rather than allowing them to react with themselves. The primary purpose is not to change the boiling range of the feedstock. Hydrotreating is most often carried out using a fixed bed reactor, although other hydroprocessing reactors can also be used for hydrotreating, an example of which is an ebullated bed hydrotreatment reactor.

The term "hydroprocessing" shall broadly refer to both "hydroconversion"/"hydrocracking" and "hydrotreating" processes.

The term "hydroconversion reactor" shall refer to any vessel in which hydroconversion of a feedstock is the primary purpose, e.g. the cracking of the feed (i.e. reducing the boiling range), in the presence of hydrogen and a hydroconversion catalyst. Hydroconversion reactors typically comprise an input port into which a heavy oil feedstock and hydrogen can be introduced, an output port from which an upgraded material can be withdrawn. Specifically, hydroconversion reactors are also characterized by having sufficient thermal energy in order to cause fragmentation of larger hydrocarbon molecules into smaller molecules by thermal decomposition. Examples of hydroconversion reactors include, but are not limited to, slurry bed reactors, also known as "entrained bed" reactors (three phase—liquid, gas, solid—reactors, wherein the solid and liquid phases can behave like a homogeneous phase), ebullated bed reactors (three phase fluidized reactors), moving bed reactors (three phase reactors with downward movement of the solid catalyst and upward or downward flow of liquid and gas), and fixed bed reactors (three phase reactors with liquid feed trickling downward over a fixed bed of solid supported catalyst with hydrogen typically flowing concurrently with the liquid, but possibly countercurrently in some cases).

The terms "hybrid bed" and "hybrid ebullated bed" and "hybrid entrained-ebullated bed" for a hydroconversion reactor shall refer to an ebullated bed hydroconversion reactor comprising an entrained catalyst in addition to a porous supported catalyst maintained into the ebullated bed reactor. Similarly, for a hydroconversion process, these terms shall thus refer to a process comprising a hybrid operation of an ebullated bed and an entrained bed in at least a same hydroconversion reactor. The hybrid bed is a mixed bed of two type of catalysts of necessarily different particle size and/or density, one type of catalyst—the "porous supported catalyst"—being maintained in the reactor and the other type of catalyst—the entrained catalyst", also commonly referred as "slurry catalyst"—being entrained out of the reactor with the effluents (upgraded feedstock). In the present invention, the entrained catalyst is a colloidal catalyst or molecular catalyst, as defined below.

The terms "slurry bed reactor", "slurry phase reactor" and "slurry reactor" shall refer to three phase, i.e. liquid, gas, and solid, slurry bed reactors for hydroconversion of heavy oil feedstock. In the present invention, it shall refer to a slurry reactor that at least includes a colloidal or molecular catalyst as defined below. In the present invention, the slurry bed reactor contains a slurry catalyst, at least a colloidal catalyst or molecular catalyst as defined below, which is the sole hydroconversion catalyst within the slurry bed reactor (no porous supported catalyst maintained in the reactor during operation as in ebullated or hybrid bed reactor). An exemplary slurry bed reactor is disclosed in U.S. Pat. No. 6,960,325 B. The liquid phase typically comprises a hydrocarbon feedstock that contain a colloidal catalyst or molecular-sized catalyst (solid particles). The solid catalyst particles, colloidal or molecular in size, together with the liquid hydrocarbon feedstock can behave like a continuous liquid phase due to the catalyst particle size (colloidal or molecular). Solid catalyst under the form of solid particulate of micron-size or larger can also be employed along with liquid and gas.

The terms "colloidal catalyst" and "colloidally dispersed catalyst" shall refer to catalyst particles having a particle size that is colloidal in size, e.g. less than 1 μm in size (diameter), preferably less than 500 nm in size, more preferably less than 250 nm in size, or less than 100 nm in size, or less than 50 nm in size, or less than 25 nm in size, or less than 10 nm in size, or less than 5 nm in size. The term "colloidal catalyst" includes, but is not limited to, molecular or molecularly-dispersed catalyst compounds.

The terms "molecular catalyst" and "molecularly dispersed catalyst" shall refer to catalyst compounds that are essentially "dissolved" or completely dissociated from other catalyst compounds or molecules in a heavy oil hydrocarbon feedstock, non-volatile liquid fraction, bottoms fraction, resid, or other feedstock or product in which the catalyst may be found. It shall also refer to very small catalyst particles or slabs that only contain a few catalyst molecules joined together (e.g. 15 molecules or less).

The terms "porous supported catalyst", "solid supported catalyst", and "supported catalyst" shall refer to catalysts that are typically used in conventional ebullated bed and fixed bed hydroconversion systems, including catalysts designed primarily for hydrocracking or hydrodemetallization and catalysts designed primarily for hydrotreating. Such catalysts typically comprise (i) a catalyst support having a large surface area and numerous interconnected channels or pores and (ii) fine particles of an active catalyst such as sulfides of cobalt, nickel, tungsten, and/or molybdenum dispersed within the pores. Supported catalysts are commonly produced as cylindrical pellets or spherical solids, although other shapes are possible.

The terms "upgrade", "upgrading" and "upgraded", when used to describe a feedstock that is being or has been subjected to hydroconversion, or a resulting material or product, shall refer to one from among: a reduction in the molecular weight of the feedstock, a reduction in the boiling point range of the feedstock, a reduction in the concentration of asphaltenes, a reduction in the concentration of hydrocarbon free radicals, a reduction of Conradson carbon residue, an increase of H/C atomic ratio of the feedstock, and a reduction in the quantity of impurities, such as sulfur, nitrogen, oxygen, and halides.

The terms "conditioned feedstock" and "conditioned heavy oil feedstock" shall refer to the heavy oil feedstock to be treated into at least a hydroconversion slurry bed reactor, feedstock in which an organic additive has been combined (herein "first conditioned feedstock"), or into which such an organic additive has been combined and then a catalyst precursor composition has been combined and mixed sufficiently so that, upon formation of the catalyst, especially by reaction with sulfur, the catalyst will comprise a colloidal or molecular catalyst dispersed within the feedstock (herein "second conditioned feedstock").

In what follows, the term "comprise" is synonymous with (means the same thing as) "include" and "contain", and is inclusive or open and does not exclude other unspecified elements. It will be understood that the term "comprise" includes the exclusive and closed term "consist".

The terms "comprised between . . . and . . . " and "in the . . . to . . . range" and "in a range of . . . to . . . " mean that the values at the limits of the interval are included in the range of values described, unless specified otherwise.

In the detailed description below, numerous specific details are set out in order to convey a deeper understanding of the process and system according to the invention. However, it will be apparent to the skilled person that the process and system can be employed without all these specific details. In other cases, characteristics which are well known have not been described in detail, in order not to complicate the description to no purpose.

FIG. 1 is a block diagram schematically illustrating the principle of the slurry bed hydroconversion process 100 according to the invention. It differs in particular from a conventional slurry bed process as disclosed for example in U58431016 in that it comprises the addition of an organic additive to the feedstock before being mixed with a catalyst precursor composition.

The terms "organic chemical compound" and "organic additive" are indifferently used in the present description to designate the organic chemical compound comprising at least one carboxylic acid function and/or at least one ester function and/or an acid anhydride function added to the heavy oil feedstock at step (a), and described in detail further below.

According to the invention, a heavy oil feedstock 101 containing a fraction of at least 50% by weight having a boiling point of at least 300° C., and containing metals and asphaltenes, is treated in a hydroconversion process 100 comprising the following steps:

(a) preparing a first conditioned heavy oil feedstock 103 by blending said heavy oil feedstock 101 with an organic chemical compound 102 comprising at least one carboxylic acid function and/or at least one ester function and/or an acid anhydride function;

(b) preparing a second conditioned heavy oil feedstock 105 by mixing a catalyst precursor composition 104 with the first conditioned heavy oil feedstock 103 from step (a) in a way such that a colloidal or molecular catalyst is formed when it reacts with sulfur;

(c) heating the second conditioned heavy oil feedstock from step (b) in at least one preheating device;

(d) introducing the heated second conditioned heavy oil feedstock 106 from step (c) into at least one slurry bed reactor and operating said slurry bed reactor in the presence of hydrogen and at hydroconversion conditions to produce an upgraded material 107.

The upgraded material 107 can be further processed in optional step (e).

In the hydroconversion process according to the invention, the colloidal or molecular catalyst is formed in situ within the second conditioned heavy oil feedstock at step (c) and/or at step (d).

Each step, stream and material involved are now detailed below.

Some of the numerical references mentioned below relate to FIG. 2, which illustrates schematically an example of a slurry bed hydroconversion system 200 according to the invention, said system being described in detail later in the description, after the description of the general process.

Heavy Oil Feedstock

The term "heavy oil feedstock" shall refer to heavy crude oils, oil sand bitumen, bottom of the barrel and resid left over from refinery processes (e.g., visbreaker bottoms), and any other lower quality material that contains a substantial quantity of high boiling hydrocarbon fractions and/or that includes a significant quantity of asphaltenes that can deactivate a solid supported catalyst and/or cause or result in the formation of coke precursors and sediments.

The heavy oil feedstock 101 can thus comprise at least one of the following feedstocks: heavy crude oil, oil sand bitumen, atmospheric tower bottoms, vacuum tower bottoms, resid, visbreaker bottoms, coal tar, heavy oil from oil shale, liquefied coal, heavy bio oils, and heavy oils comprising plastic waste and/or a plastic pyrolysis oil.

Plastic pyrolysis oils are oils obtained from the pyrolysis of plastics, preferably of plastic waste, and may be obtained from a thermal, catalytic pyrolysis treatment or else may be prepared by hydropyrolysis (pyrolysis in the presence of a catalyst and of hydrogen).

In particular, the treated heavy oil feedstock contains hydrocarbon fractions of which at least 50% by weight, preferably at least 80% by weight has a boiling temperature of at least 300° C., preferably at least 350° C. or at least 375° C.

These are crude oils or heavy hydrocarbon fractions resulting from the atmospheric and/or vacuum distillation of a crude oil. They can also be atmospheric and/or vacuum residues, and in particular atmospheric and/or vacuum residues resulting from hydrotreatment, hydrocracking and/or hydroconversion. It can also be vacuum distillates, cuts from a catalytic cracking unit such as fluid catalytic cracking (FCC), a coking or visbreaking unit.

Preferably, they are vacuum residues. Generally these residues are fractions in which at least 80% by weight has a boiling temperature of at least 450° C. or more, and most often at least 500° C. or 540° C.

Aromatic cuts extracted from a lubricant production unit, deasphalted oils (raffinates from a deasphalting unit), and asphalt (residues from a deasphalting unit) are also suitable as feedstock.

The feedstock can also be a residual fraction from direct coal liquefaction (vacuum distillate and/or atmospheric and/or vacuum residue from e.g. H-Coal process, registered trademark), coal pyrolysis or shale oil residues, or a residual fraction from the direct liquefaction of lignocellulosic biomass alone or mixed with coal and/or a petroleum fraction (herein called "heavy bio oils").

Examples of heavy oil feedstocks include, but are not limited to, Lloydminster heavy oil, Cold Lake bitumen, Athabasca bitumen, Urals crude oil, Arabian Heavy crude oil, Arabian Light crude oil, atmospheric tower bottoms, vacuum tower bottoms, residuum (or "resid"), resid pitch, vacuum residue, solvent deasphalting pitch, and nonvolatile liquid fractions that remain after subjecting crude oil, bitumen from tar sands, liquefied coal, oil shale, or coal tar feedstocks to distillation, hot separation, and the like and that contain higher boiling fractions and/or asphaltenes.

All these feedstocks can be used alone or in a mixture.

The heavy oil feedstocks treated in the process and system according to the invention contain metals and asphaltenes, in particular $C_7$ asphaltenes, and other impurities such as sulfur, and nitrogen.

The term "asphaltene" shall refer to the fraction of a heavy oil feedstock that is typically insoluble in paraffinic solvents such as propane, butane, pentane, hexane, and heptane and that includes sheets of condensed cyclic compounds held together by hetero atoms such as sulfur, nitrogen, oxygen and metals. Asphaltenes broadly include a wide range of complex compounds having anywhere from 80 to 160,000 carbon atoms. Asphaltenes are defined operationally as "$C_7$ asphaltenes", i.e. heptane-insoluble compounds according to the standard ASTM D 6560 (also corresponding to standard NF T60-115), and any content in asphaltenes refers to $C_7$ asphaltenes in the present description. $C_7$ asphaltenes are compounds known to inhibit the conversion of residual cuts, both by their ability to form heavy hydrocarbon residues, commonly known as coke, and by their tendency to produce sediments that severely limit the operability of hydrotreating and hydroconversion units.

The heavy oil feedstock 101 can typically have sulfur at a content of greater than 0.5% by weight, Conradson carbon residue of at least 3% by weight, $C_7$ asphaltenes at a content of greater than 1% by weight, transition and/or post-transition and/or metalloid metals at a content of greater than 2 ppm by weight, and alkali and/or alkaline earth metals at a content of greater than 2 ppm by weight.

These types of feedstocks are indeed generally rich in impurities such as metals, in particular transition metal (e.g. Ni, V) and/or post-transition metal, and/or metalloid, for which a content can be greater than 2 ppm by weight, or greater than 20 ppm by weight, and even greater than 100 ppm by weight, and also alkali metal (e.g. Na) and/or alkaline earth metal whose content can be higher than 2 ppm by weight, even higher than 5 ppm by weight, and even higher than 7 ppm by weight or ppm by weight.

The sulfur content is indeed generally higher than 0.5% by weight, and even higher than 1% by weight, or even greater than 2% by weight.

The content of $C_7$ asphaltenes can indeed be at least 1% by weight, and even higher than 3% by weight.

The Conradson carbon residue is indeed in general higher than 3% by weight, and even of at least 5% by weight. The Conradson carbon residue is defined by ASTM D 482 standard and represents the amount of carbon residue produced after pyrolysis under standard conditions of temperature and pressure.

These contents are expressed in % by weight of the total weight of the feed.

Step (a): Preparation of the First Conditioned Heavy Oil Feedstock: Heavy Oil Feedstock+Organic Additive Step (a) comprises blending said heavy oil feedstock 101 with an organic chemical compound 102 comprising at least one carboxylic acid function and/or at least one ester function and/or an acid anhydride function. This blending forms what is referred to herein as a first conditioned heavy oil feedstock 103.

This step is carried out before step (b) of thorough mixing with a catalyst precursor composition that will lead to the formation of a colloidal or molecular catalyst dispersed within the heavy oil when it will react with sulfur.

The inventors have shown that the mixing step (a) between such an organic additive and the heavy oil feedstock, before step (b), improves the slurry bed hydroconversion process, in particular by reducing the fouling of the equipment, especially upstream the slurry hydroconversion reactor in the feedstock heating equipment at step (c).

Without being bound by any theory, the organic additive, mixed with the heavy oil feedstock, allows a better solubility of the colloidal or molecular catalyst precursor in the feed, avoiding or reducing fouling in particular due to metal deposition in equipment upstream the slurry hydroconversion reactor like in the heating equipment, and improving therefore the dispersion of the colloidal or molecular catalyst formed at step c) and/or at a later stage, thus generating a greater availability of the metal active sites, favoring the hydrogenation of free radicals which are precursors of coke and sediments, and generating a substantial reduction of the fouling of the equipment.

The Organic Additive

The organic additive 102 having at least one carboxylic acid function and/or at least one ester function and/or an acid anhydride function preferably comprises at least 6 carbon atoms, and more preferably at least 8 carbon atoms.

Typically, the organic additive 102 is not a catalyst precursor nor a catalyst.

In particular, the organic additive 102 does not contain any metal.

Examples of organic additive include, but are not limited to, 2-ethylhexanoic acid, naphthenic acid, caprylic acid, adipic acid, pimelic acid, suberic acid, azelaic acid, sebacic acid, ethyl octanoate, ethyl 2-ethylhexanoate, 2-ethylhexyl 2-ethylhexanoate, benzyl 2-ethylhexanoate, diethyl adipate, dimethyl adipate, bis(2-ethylhexyl) adipate, dimethyl pimelate, dimethyl suberate, monomethyl suberate, hexanoic anhydride, caprylic anhydride. Advantageously, the organic additive is an organic chemical compound selected from the group consisting of the list of specific compounds recited just above, and a mixture thereof.

Preferably, the organic additive is an organic chemical compound comprising at least one carboxylic acid function, and more preferably selected from the group consisting of 2-ethylhexanoic acid, naphthenic acid, caprylic acid, adipic acid, pimelic acid, suberic acid, azelaic acid, and sebacic acid.

More preferably, the organic additive comprises, or consists of, 2-ethylhexanoic acid.

The organic additive can be an organic chemical compound comprising at least one ester function and/or an acid anhydride function, and for example selected from the group consisting of ethyl octanoate, ethyl 2-ethylhexanoate, 2-ethylhexyl 2-ethylhexanoate, benzyl 2-ethylhexanoate, diethyl adipate, dimethyl adipate, bis(2-ethylhexyl) adipate, dimethyl pimelate, dimethyl suberate, monomethyl suberate, and/or from the group consisting of hexanoic anhydride and caprylic anhydride.

More preferably, the organic additive comprising at least one ester function and/or an acid anhydride function comprises, or consists of, ethyl octanoate or 2-ethylhexyl 2-ethylhexanoate or a mixture thereof, and preferably is ethyl octanoate or 2-ethylhexyl 2-ethylhexanoate.

This step (a) of mixing the organic additive 102 with the heavy oil feedstock 101 forming the first conditioned heavy oil feedstock 103 is carried out before step (b) of thorough/intimate mixing with a catalyst precursor composition, which will lead to the formation of the colloidal or molecular catalyst dispersed in the heavy oil.

The organic additive is preferably added such that the molar ratio of organic additive to active metal(s) of the catalyst precursor composition added at step (b) is in a range of about 0.1:1 to about 20:1, more preferably in a range of about 0.75:1 to about 7:1, and even more preferably in a range of about 1:1 to about 5:1. The term "about" shall refer to an approximation of ±5%, preferably ±1%.

Advantageously, the catalyst precursor composition added at step (b) comprises Mo, e.g. molybdenum 2-ethylhexanoate, and the organic additive is preferably added such that the molar ratio of organic additive to Mo of the catalyst precursor composition added at step (b) is in a range of about 0.1:1 to about 20:1, more preferably in a range of about 0.75:1 to about 7:1, and even more preferably in a range of about 1:1 to about 5:1.

Mixing with the Organic Additive

The mixing of the organic additive and the heavy oil feedstock is advantageously carried out in a first conditioner mixer 210.

The first conditioner mixer 210 may comprise an active mixing device, any type of injection system for conduits or any type of in-line mixer as detailed below.

According to one or more embodiments, the preparation of the first conditioned heavy oil feedstock 103 comprises mixing said organic additive 102 and said heavy oil feedstock 101 in a dedicated vessel of an active mixing device (forming the first conditioner mixer 210).

The term "active mixing device" shall refer to a mixing device comprising a mobile part, e.g. a stirring rod, to actively mix the components.

Such a configuration can in particular increase the dispersion of the colloidal or molecular catalyst formed in a later stage. The use of a dedicated vessel also enables a long residence time.

According to one or more embodiments, the preparation of the first conditioned heavy oil feedstock 103 comprises injecting said organic chemical compound 102 into a pipe conveying said heavy oil feedstock 101 towards the slurry bed reactor. The first conditioner mixer 210 thus comprises in such a configuration the portion of the pipe wherein the mixing is done, and eventually additional systems to help the mixing, as for example static in-line mixers as further described in relation to step (b).

A configuration of this kind make it possible in particular to reduce the capital investment in equipment and the physical footprint required, by comparison with mixing in a dedicated vessel.

The residence time of the organic additive with the heavy oil feedstock prior to mixing with the catalyst precursor composition at stage (b) forming the second conditioned heavy oil feedstock 105 is preferably between 1 second and 10 hours, more preferably between 1 second and 1 hour, and even more preferably between 1 second and 30 minutes.

In the present description, a mixing time (or residence time for mixing) of 1 second includes an instantaneous mixing.

The mixing of the organic additive and the heavy oil feedstock is preferably carried out between room temperature, e.g. 15° C., and 300° C., more preferably between 70° C. and 200° C., for example at 150° C. The temperature at which the mixing is done is advantageously the actual temperature of the heavy oil feedstock stream 101.

The temperature in step (a) should preferably be lower than a decomposition temperature of the catalyst precursor composition.

The pressure for the mixing step (a) is also advantageously the actual pressure of the stream of heavy oil feedstock 101. Preferably, the gauge pressure for the mixing step (a) is between 0 MPa and 25 MPa, more preferably between 0.01 MPa and 5 MPa.

In the case of heavy oil feedstocks which are solid or extremely viscous at room temperature, such feedstocks may advantageously be heated in order to soften them and to produce a feedstock with a viscosity sufficiently low to enable effective mixing of the organic additive, and particularly with the catalyst precursor composition in additional step (b). In general, the decrease in the viscosity of the heavy oil feedstock will reduce the time for complete and intimate mixing of the catalyst precursor composition in the first conditioned feedstock at step (b). However, the feedstock should not be heated to a temperature beyond that at which there is significant thermal decomposition of the catalyst precursor composition occurs until after thorough and complete mixing with the catalyst precursor composition at step (b). Premature thermal decomposition of the catalyst precursor composition results generally in the formation of micron-sized or larger catalyst particles rather than a colloidal or molecular catalyst.

At step (a), the blending of the heavy oil feedstock 101 with the organic additive 102 can be done for the heavy oil feedstock 101, in part or completely.

According to one or more preferred embodiments, the mixing step (a) is carried out between the organic additive 102 and the entire stream of the heavy oil feedstock 101 sent to the hydroconversion system. In one or more alternative embodiments, the mixing step (a) is carried out between the organic additive 102 and a part of the stream of the heavy oil feedstock 101 sent to the hydroconversion. Thus preparing the first conditioned heavy oil feedstock 103 can be carried out by blending at least a part of the flow of said heavy oil feedstock 101, for example at least 50 wt. % of the flow of said heavy oil feedstock 101, with the organic additive 102. The complementary part of the stream of said heavy oil feedstock 101 may be reincorporated after the catalyst precursor composition has been added (step (b)), that is mixed with the second conditioned heavy oil feedstock before its preheating at step (c).

Step (b): Preparation of the Second Conditioned Heavy Oil Feedstock: Mixing with the Catalyst Precursor Composition The first conditioned oil feedstock 103 is subsequently mixed with a catalyst precursor composition 104 to form a second conditioned heavy oil feedstock 105.

Catalyst Precursor Composition

The catalyst precursor composition is selected from all metal catalyst precursors known to a person skilled in the art, capable of forming a colloidally or molecularly dispersed catalyst (i.e., the slurry catalyst) in the presence of hydrogen and/or $H_2S$ and/or any other source of sulfur, and enabling the hydroconversion of a heavy oil feedstock after injection into said heavy oil feedstock.

The catalyst precursor composition is advantageously an oil soluble catalyst precursor composition containing at least one transition metal.

The catalyst precursor composition preferably comprises an oil soluble organo-metallic compound or complex.

The catalyst precursor composition can comprise an oil soluble organo-metallic or bimetallic compound or complex comprising one or two of the following metals: Mo, Ni, V, Fe, Co or W, or blends of such compounds/complexes.

The oil soluble catalyst precursor composition preferably has a decomposition temperature (temperature under which the catalyst precursor composition is substantially chemically stable) in a range from 100° C. to 350° C., more preferably in a range of 150° C. to 300° C., and most preferably in a range of 175° C. to 250° C.

The oil soluble organo-metallic compound or complex is preferably selected in the group consisting of molybdenum 2-ethylhexanoate, molybdenum naphthanate, vanadium naphthanate, vanadium octoate, molybdenum hexacarbonyl, vanadium hexacarbonyl, and iron pentacarbonyl.

These compounds are non-limiting examples of oil soluble catalyst precursor compounds.

More preferably the catalyst precursor composition comprises molybdenum, and for example comprises a compound selected in the group consisting of molybdenum 2-ethylhexanoate, molybdenum naphthanate, and molybdenum hexacarbonyl.

A currently preferred catalyst precursor composition comprises, or consists of, molybdenum 2-ethylhexanoate (also commonly known as molybdenum octoate). Typically, molybdenum 2-ethylhexanoate contains 15% by weight of molybdenum and has a decomposition temperature or range high enough to avoid substantial decomposition when mixed with a heavy oil feedstock at a temperature below 250° C.

One of skill in the art can, following the present disclosure, select a mixing temperature profile that results in mixing of a selected precursor composition without substantial thermal decomposition prior to formation of the colloidal or molecular catalyst.

Mixing with the Catalyst Precursor Composition

The mixing of the catalyst precursor composition and the first conditioned heavy oil feedstock is performed in a second conditioner mixer 220.

The catalyst precursor composition 104, preferably an oil soluble catalyst precursor composition, can be pre-mixed with a diluent hydrocarbon stream to form a diluted precursor mixture, as described in documents US2005/0241991, U.S. Ser. No. 10/822,553 or U.S. Ser. No. 10/941,353, and addressed below.

According to one or more preferred embodiments, step (b) comprises:

(b1) pre-mixing the catalyst precursor composition 104 with a hydrocarbon oil (diluent) to form a diluted precursor mixture, said pre-mixing being carried out preferably at a temperature lower than that at which a substantial portion of the catalyst precursor composition begins to decompose, preferably between room temperature, e.g. 15° C., and 300° C., and advantageously for a period of time from 1 second to 30 minutes; and (b2) mixing said diluted precursor mixture with the first conditioned heavy oil feedstock 103, preferably between room temperature, e.g. 15° C. and 300° C. and advantageously for a period of time from 1 second to 30 minutes.

Examples of suitable hydrocarbon diluents include, but are not limited to, vacuum gas oil known as "VGO" (which typically has a boiling range of 360° C.-524° C.), decant oil or cycled oil (which typically has a boiling range of 360° C.-550° C.), light gas oil (which typically has a boiling range of 200° C.-360° C.), vacuum residues (which typically has a boiling temperature range of 524° C.+), deasphalted oils, and resins.

The hydrocarbon diluent is preferably a VGO.

The mass ratio of catalyst precursor composition 104 to hydrocarbon oil diluent is preferably in a range of 1:500 to 1:1, more preferably in a range of 1:150 to 1:2, and most preferably in a range of 1:100 to 1:5 (e.g. 1:100, 1:50, 1:30, or 1:10).

The catalyst precursor composition 104 is more preferably mixed with the hydrocarbon diluent at temperature between room temperature, e.g. 15° C., and 200° C., even more preferably between 50° C. and 200° C., even more preferably between 75° C. and 150° C., and even more preferably between 75° C. and 100° C., to form the diluted precursor mixture.

It will be appreciated that the actual temperature at which the diluted precursor mixture is formed typically depends largely on the decomposition temperature of the particular precursor composition that is utilized.

The catalyst precursor composition 104 is more preferably mixed with the hydrocarbon oil diluent for a period of time in a range from 1 second to 10 minutes, and most preferably in a range from 2 seconds to 3 minutes.

The actual mixing time depends, at least partly, on the temperature (i.e., which affects the viscosity of the fluids) and the intensity for mixing. The intensity of mixing depends, at least partly, on the number of stages e.g. for in-line static mixer.

Whereas it is within the scope of the invention to directly blend the catalyst precursor composition 104 with the first conditioned heavy oil feedstock, care must be taken in such cases to mix the components for a time sufficient to thoroughly blend the catalyst precursor composition within the feedstock before forming the catalyst. However, a long mixing time, for example 24-hour mixing, can make certain industrial operations prohibitively expensive.

Pre-mixing the catalyst precursor composition 104 with a hydrocarbon diluent prior to blending the diluted precursor mixture with the heavy oil feedstock greatly aids in thoroughly and intimately blending the precursor composition within the feedstock, particularly in the relatively short period of time required for large-scale industrial operations to be economically viable.

The formation of a diluted precursor mixture shortens the overall mixing time by (1) reducing or eliminating differences in solubility between the more polar catalyst precursor composition and the heavy oil feedstock, (2) reducing or eliminating differences in rheology between the catalyst precursor composition and the heavy oil feedstock, and/or (3) breaking up the catalyst precursor molecules to form a solute within a hydrocarbon oil diluent that is much more easily dispersed within the heavy oil feedstock. It is particularly advantageous to first form a diluted precursor mixture in the case where the heavy oil feedstock contains water (e.g. condensed water). Otherwise, the greater affinity of the water for the polar catalyst precursor composition can cause localized agglomeration of the catalyst precursor composition, resulting in poor dispersion and formation of micron-sized or larger catalyst particles. The hydrocarbon oil diluent is preferably substantially water free (i.e., contains less than 0.5% by weight of water, preferably less than 0.1% by weight of water, and more preferably less than 750 ppm by weight of water) to prevent the formation of substantial quantities of micron-sized or larger catalyst particles.

The diluted precursor mixture is then combined with the first conditioned heavy oil feedstock 103 and mixed for a sufficient time and in a manner so as to disperse the catalyst precursor composition throughout the feedstock in order to yield a second conditioned heavy oil feedstock 105 in which the catalyst precursor composition is thoroughly/intimately mixed within the heavy oil feedstock. In order to obtain sufficient mixing of the catalyst precursor composition within the heavy oil feedstock before forming the colloidal or molecular catalyst, the diluted precursor mixture and heavy oil feedstock are more preferably mixed for a period of time in a range from 1 second to 10 minutes, and even more preferably in a range from 2 seconds to 3 minutes. Increasing the vigorousness and/or the shearing energy of the mixing process generally reduce the time required to effect thorough/intimate mixing.

Examples of mixing apparatus that can be used to effect thorough mixing of the catalyst precursor composition 104 and of the first conditioned heavy oil feedstock 103 include, but are not limited to, high shear mixing such as mixing created in a pump with a propeller or turbine impeller; multiple static in-line mixers; multiple static in-line mixers in combination with in-line high shear mixers; multiple static in-line mixers in combination with in-line high shear mixers; multiple static in-line mixers in combination with in-line high shear mixers followed by a pump around in the surge vessel; combinations of the above devices followed by one or more multi-stage centrifugal pumps.

According to one embodiment, continuous rather than batch-wise mixing can be carried out using high energy pumps having multiple chambers within which the catalyst precursor composition 104 and the first conditioned heavy oil feedstock 103 are churned and mixed as part of the pumping process itself. The foregoing mixing apparatus may also be used for the premixing step (b1) discussed above in which the catalyst precursor composition 104 is mixed with the hydrocarbon oil diluent to form the catalyst precursor mixture.

Alternatively, the diluted precursor mixture 104 can be initially mixed with 20% of the first conditioned heavy oil feedstock, the resulting mixed first conditioned heavy oil feedstock can be mixed in with another 40% of the first conditioned heavy oil feedstock, and the resulting 60% of the mixed first conditioned heavy oil feedstock can be mixed in with the remaining 40% of first conditioned heavy oil in accordance with good engineering practice of progressive dilution to thoroughly disperse the catalyst precursor composition 104 in the heavy oil feedstock. Mixing time in the appropriate mixing devices or methods described herein should still be used in the progressive dilution approach.

The first conditioned heavy oil feedstock 103 and diluted precursor mixture are preferably mixed and conditioned at a temperature in a range from 50° C. to 200° C., and more preferably in a range from 75° C. to 175° C., to yield the second conditioned oil feedstock. Preferably, the gauge pressure is between 0 MPa and 25 MPa, more preferably between 0.05 MPa and 5 MPa Step (c): Heating the Second Conditioned Heavy Oil Feedstock The second conditioned oil feedstock 105 formed at step (b) is then heated in at least one preheating device 230, before being introduced in the slurry bed reactor for hydroconversion.

The second conditioned oil feedstock 105 is sent to the at least one preheating device 230 optionally pressurized by a pump.

The preheating device comprises any heating means capable of heating a heavy oil feedstock known to a person skilled in the art. The preheating device can comprise a furnace comprising at least a preheating chamber, and/or tubes in which the oil feed flows, mixer of the second conditioned oil feedstock with $H_2$, any type of suitable heat exchangers, for example tube or spiral heat exchangers in which the oil feed flows, etc.

This pre-heating of the second conditioned heavy oil feedstock then allows a target temperature in the slurry hydroconversion reactor to be reached at the later step (d).

The second conditioned oil feedstock 105 is more preferably heated in the preheating device 230 to a temperature in a range of 280° C. to 450° C., even more preferably in a range of 300° C. to 400° C., and most preferably in a range of 320° C. to 365° C., in particular in order to later reach a target temperature in the hydroconversion reactor at step (d).

The skin temperature of the preheating device, e.g. skin temperature of the steel shell of a chamber or tubes of a furnace or heat exchanger(s), can reach 400° C. to 650° C. The mixing of the heavy oil feedstock with the organic additive at step (a) avoids or reduces fouling that can occur in the preheating device at these high temperatures.

According to one or more embodiments, the second conditioned oil feedstock is heated to a temperature that is 100° C. less than the hydroconversion temperature within the slurry hydroconversion reactor, preferably about 50° C. less than the hydroconversion temperature. For example, for a hydroconversion temperature in the range 410° C.-440° C., the second conditioned oil feedstock can be heated at step (c) at a temperature in the range 310° C.-340° C.

The absolute pressure is comprised between atmospheric pressure (e.g. 0.101325 MPa) and 38 MPa, preferably between 5 MPa and 25 MPa and preferably between 6 MPa and 20 MPa.

Heating at this step (c) advantageously causes the second conditioned oil feedstock to liberate sulfur that can combine with the metal of the catalyst precursor composition.

According to one or more embodiments, the colloidal or molecular catalyst is formed, or at least starts forming, in situ within the second conditioned heavy oil feedstock at this step (c) of heating in the preheating device 230.

In order to form the colloidal or molecular catalyst, sulfur has to be available (e.g. as $H_2S$) to combine with the metal from the dispersed catalyst precursor composition.

Formation of the Colloidal or Molecular Catalyst In Situ within the Second Conditioned Heavy Oil Feedstock The general formation of the colloidal or molecular catalyst in situ within the second conditioned heavy oil feedstock is described in detail below, as well as the conditions required for such a formation at step (c) and/or (d).

In the case where the heavy oil feedstock includes sufficient or excess sulfur, the final activated catalyst may be formed in situ by heating the second conditioned heavy oil feedstock to a temperature sufficient to liberate the sulfur therefrom.

A source of sulfur can thus be $H_2S$ dissolved in the heavy oil feedstock, or $H_2S$ contained in hydrogen recycled to the slurry bed hydroconversion reactor for hydroconversion or $H_2S$ coming from organosulfur molecules present in the feedstock or eventually introduced beforehand in the heavy oil feedstock (injection of dimethyl disulfide, thioacetamide, any sulfur-containing hydrocarbon feedstock of the type of mercaptans, sulfides, sulfur-containing petroleum, sulfur-containing gas oil, sulfur-containing vacuum distillate, sulfur-containing residue), such an injection being rare and reserved for very atypical heavy oil feedstocks.

Thus a source of sulfur can be sulfur compounds within the feedstock or a sulfur compound added to the feedstock.

According to one or more embodiments, the formation of the dispersed colloidal or molecular catalyst is carried out with a total gauge pressure of between 0 MPa and 25 MPa.

Due to the thorough mixing at step (b), a molecularly-dispersed catalyst may form upon reacting with sulfur to form the metal sulfide compound. Under some circumstances, minor agglomeration may occur, yielding colloidal-sized catalyst particles. However, it is believed that taking care to thoroughly mix the catalyst precursor composition throughout the first conditioned oil feedstock at step (b) will yield individual catalyst molecules rather than colloidal particles. Simply adding together, while failing to sufficiently mix, typically causes formation of large agglomerated metal sulfide compounds that are micron-sized or larger.

In order to form the metal sulfide catalyst, the second conditioned oil feedstock 105 is preferably heated to a temperature in a range of room temperature, e.g 15° C., to 500° C., more preferably in the range of 200° C. to about 500° C., even more preferably in the range of 250° C. to 450° C., and more even preferably in the range of 300° C. to 435° C.

The temperature used at step (c) and/or (d) allows the formation of the metal sulfide catalyst.

The colloidal or molecular catalyst can thus be formed, at least in part, during this heating step (c), before the heated second conditioned oil feedstock is introduced into the slurry bed hydroconversion reactor at step (d).

The colloidal or molecular catalyst can also be formed in situ within the slurry bed hydroconversion reactor itself at step (d), especially either totally or in part in the case it has started to form at step (c).

The concentration of the metal of the catalyst, preferably molybdenum, in the second conditioned oil feedstock 105 is preferably in a range of 10 ppm to 10000 ppm by weight of the heavy oil feedstock, more preferably in a range of 50 ppm to 6000 ppm by weight, more preferably in a range of 100 ppm to 1000 ppm by weight, even more preferably in a range of 100 ppm to 800 ppm by weight, and most preferably in a range of 150 ppm to 400 ppm by weight.

The metal of the catalyst may become more concentrated as volatile fractions are removed from a non-volatile resid fraction.

Since the colloidal or molecular catalyst tends to be very hydrophilic, the individual particles or molecules will tend to migrate toward the more hydrophilic moieties or molecules within the heavy oil feedstock, especially asphaltenes. While the highly polar nature of the catalyst compound causes or allows the colloidal or the molecular catalyst to associate with asphaltene molecules, it is the general incompatibility between the highly polar catalyst compound and the hydrophobic heavy oil feedstock that necessitates the aforementioned intimate or thorough mixing of the oil soluble catalyst precursor composition within the heavy oil feedstock prior to formation of the colloidal or molecular catalyst.

Preferably, the colloidal or molecular catalyst comprises molybdenum disulfide.

Theoretically, a nanometer-sized crystal of molybdenum disulfide has 7 molybdenum atoms sandwiched in between 14 sulfur atoms, and the total number of molybdenum atoms exposed at the edge, thus available for catalytic activity, is greater than in a micron-sized crystal of molybdenum disulfide. In practical terms, forming small catalyst particles as in the present invention, i.e. colloidal or molecular catalyst, with an enhanced dispersion results in more catalyst particles and more evenly distributed catalyst sites throughout the oil feedstock. Moreover, nanometer-sized or smaller molybdenum disulfide particles are believed to become intimately associated with asphaltene molecules.

Step (d): Hydroconversion of the Heated Second Conditioned Heavy Oil Feedstock

The heated second conditioned feedstock 106 is then introduced, optionally pressurized by a pump especially if not already pressurized before step (c), into at least one slurry bed reactor 240 together with hydrogen 201, and is operated at hydroconversion conditions to produce an upgraded material 107.

As previously mentioned, the colloidal or molecular catalyst can form in situ within the slurry bed hydroconversion reactor itself at step (d), if not totally formed or not formed at all at step (c).

When the colloidal or molecular catalyst is formed in situ within the second conditioned heavy oil feedstock at step (c), the heated second conditioned feedstock 106 already contains the colloidal or molecular catalyst, in part or in totality, when entering the at least one slurry bed reactor 240.

The slurry bed reactor 240 comprises a liquid phase which comprises said heated second conditioned heavy oil feedstock 106 containing the colloidal or molecular catalyst dispersed therein, and a gaseous phase comprising hydrogen.

This type of slurry bed reactor is well known to a person skilled in the art.

The slurry bed reactor preferably comprises an up-flow of liquid and of gas.

The slurry bed reactor for hydroconversion of heavy hydrocarbon oils can be, like most slurry bed reactors, an empty plug flow-type vessel, since the second conditioned heavy oil feedstock 106 containing the colloidal or molecular catalyst dispersed therein behaves as a homogeneous phase.

During operation with an ascending flow of liquid and gas, the slurry bed reactor preferably includes an input port located at or near the bottom of the slurry bed reactor through which the heated second conditioned feedstock 106 is introduced together with hydrogen 201, and an output port at or near the top of the reactor through which the upgraded material 107 is withdrawn. The colloidal or molecular hydroconversion catalyst is dispersed throughout the feedstock within the slurry bed reactor and is entrained out of the reactor with the effluents comprising the upgraded material 107.

The slurry bed reactor may comprise at its bottom a stirrer helping to more evenly disperse the hydrogen within the feedstock.

The slurry phase reactor can comprise a former ebullated bed reactor converted into a slurry phase reactor by removing the porous supported catalyst from the former ebullated bed reactor. In such cases, the slurry bed reactor can comprise at its bottom a stirrer, and alternatively or in addition to such a stirrer, the slurry bed reactor may include a recycle channel, recycling pump, and distributor grid plate as in conventional ebullated bed reactors allowing continuous recycling of at least a part of a liquid fraction drawn off at the top of the reactor and reinjected at the bottom of the reactor and promote more even dispersion of reactants, catalyst, and heat, and as exemplified in document U.S. Pat. No. 6,960,325B also comprising a cup riser.

If an internal recycled feedstock is carried out, such internal recycled feedstock can be blended with fresh heated second conditioned feedstock 106 and supplemental hydrogen gas 201.

The presence of colloidal or molecular catalyst within the slurry bed reactor provides the catalytic hydrogenation activity. Capping of free radicals minimizes formation of sediments and coke precursors as has already been explained.

In the hydroconversion step (d), said heated second conditioned feedstock 106 is generally converted under conventional conditions for hydroconversion of a heavy oil feedstock.

According to one or more embodiments, the hydroconversion step (d) is carried out under an absolute pressure of between 2 and 38 MPa, preferably between 5 and 25 MPa and preferably between 6 and 20 MPa, and at a temperature between 300° C. and 550° C., preferably between 350° C. and 500° C., preferably between 370° C. and 450° C., and more preferably between 400° C. and 440° C., and even more preferably between 410° C. and 435° C.

According to one or more embodiments, the liquid hourly space velocity (LHSV) of the feedstock relative to the volume of each slurry bed reactor is between $0.05^{-1}$ and $10^{-1}$, preferably between $0.10^{-1}$ and $2^{-1}$ and preferably between $0.10^{-1}$ and $1^{-1}$. According to another embodiment, the LHSV is between $0.05^{-1}$ and $0.09^{-1}$. LHSV is defined as the liquid feedstock volumetric flow rate at room temperature and atmospheric pressure (typically 15° C. and 0.101325 MPa) per reactor volume.

According to one or more embodiments, the amount of hydrogen mixed with the heavy oil feedstock 106 is preferably between 50 and 5000 normal cubic meters ($Nm^3$) per cubic meter (m) of liquid heavy oil feedstock, such as between 100 and 2000 $Nm^3/m^3$ and preferably between 500 and 1500 $Nm^3/m^3$.

According to one or more embodiments, the hydroconversion step (d) is carried out in one or more slurry bed hydroconversion reactors, which can be in series and/or in parallel.

Step (e): Further Processing of the Upgraded Material from Hydroconversion Step (d)

The upgraded material 107 can be further processed.

Examples of such further processing comprise, without limitation, at least one from among: a separation of hydrocarbon fractions of the upgraded material, a further hydroconversion in one or more supplemental slurry bed reactors or hybrid ebullated entrained bed reactors or ebullated bed reactors, which can be in series and/or in parallel, to produce a further upgraded material, a fractionation of hydrocarbon cuts of the further upgraded material, a deasphalting of at least a part of the upgraded material 107 or a heavy liquid fraction resulting from a fractionation of the upgraded material or further upgraded material, a purification in a guard bed of the upgraded or further upgraded material to remove at least a portion of the colloidal or molecular catalyst and metal impurities.

The various hydrocarbon fractions that can be produced from the upgraded material 107 can be sent to different processes in the refinery, and details on these post-processing are not described herein as they are generally known to the skilled person and will complicate the description to no purpose.

For example, gas fractions, naphtha, middle distillates, VGO, DAO can be sent to processes of hydrotreating, steam cracking, fluid catalytic cracking (FCC), hydrocracking, lubricating oil extraction, etc., residues (atmospheric or vacuum residues) can also be post-processed, or used for other applications like gasification, bitumen production etc. Heavy fractions, including residues, can also be recycled in the hydroconversion process, for example in the slurry bed reactor.

Figure 2:
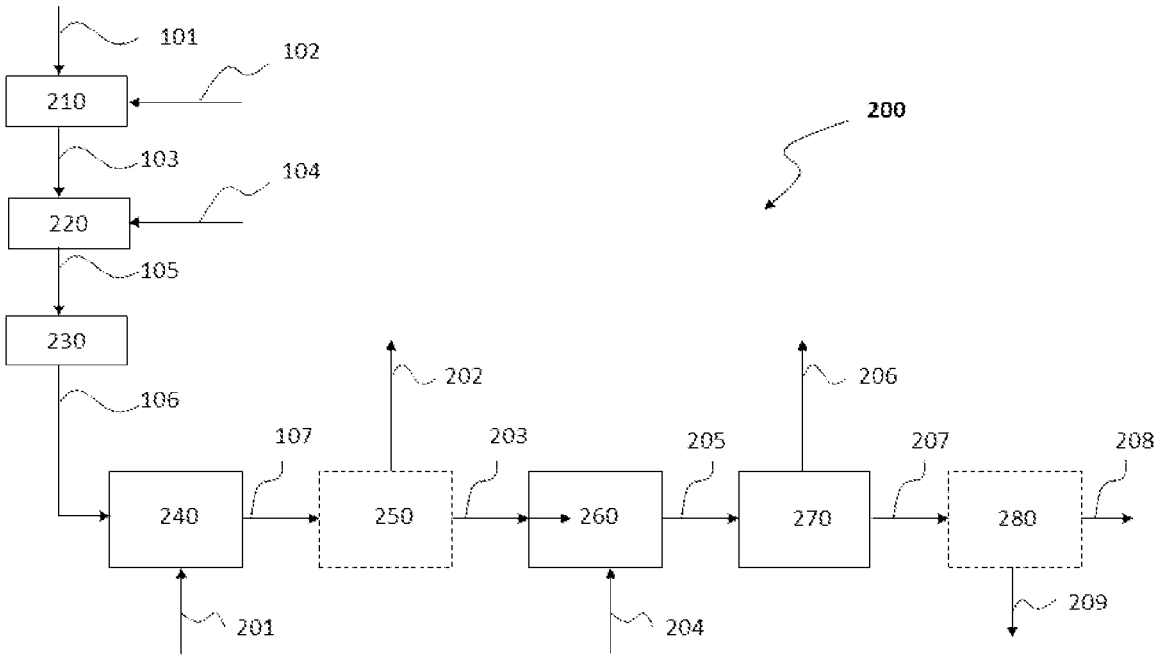
FIG. 2 is a block diagram illustrating an example of a slurry bed hydroconversion process and system according to the invention.

According to one or more embodiments, as illustrated in FIG. 2, the process further comprises:

- a second hydroconversion step in a second slurry bed reactor 260 in the presence of hydrogen 204 of at least a portion or all of the upgraded material resulting from the hydroconversion step (d) or optionally of a liquid heavy fraction 203 that boils predominantly at a temperature greater than or equal to 350° C. resulting from an optional separation step separating a portion or all of the upgraded material resulting from the hydroconversion step (d), said second slurry bed reactor 260 being operated at hydroconversion conditions to produce a hydroconverted liquid effluent 205 with reduced heavy residue fraction, reduced Conradson carbon residue, and possibly a reduced quantity of sulfur, and/or nitrogen;
- a step of fractionating a portion or all of said hydroconverted liquid effluent 205 in a fractionation section 270 to produce at least one heavy cut 207 that boils predominantly at a temperature greater than or equal to 350° C., said heavy cut containing a residual fraction that boils at a temperature greater than or equal to 540° C.;
- an optional step of deasphalting a portion or all of said heavy cut 207 in a deasphalter 280 with at least one hydrocarbon solvent to produce a deasphalted oil DAO 208 and a residual asphalt 209.

Said second hydroconversion step is performed in a manner similar to that which was described for the hydroconversion step (d), and its description is not therefore repeated here. This applies notably for the operating conditions, the equipment used, with the exception of the specifications given below.

As for the hydroconversion step (d), the second hydroconversion step is performed in a second slurry bed reactor 260 similar to slurry bed reactor 240.

In this additional hydroconversion step, the operating conditions may be similar or different from those in the hydroconversion step (d), the temperature remaining within the range between 300° C. and 550° C., preferably between 350° C. and 500° C., more preferably between 370° C. and 450° C., even preferably between 400° C. and 440° C., and even more preferably between 410° C. and 435° C., and the amount of hydrogen introduced into the reactor remaining within the range between 50 and 5000 $Nm^3/m^3$ of liquid feedstock, preferably between 100 and 2000 $Nm^3/m^3$, and even more preferably between 500 and 1500 $Nm^3/m^3$. The other pressure and LHSV parameters are within ranges identical to those described for the hydroconversion step (d).

The optional separation step, separating a portion or all of the upgraded material 107 to produce at least two fractions including the heavy liquid fraction 203 that boils predominantly at a temperature greater than or equal to 350° C., is carried out in a separation section 250.

The other cut(s) 202 are light and intermediate cut(s). The light fraction thus separated contains mainly gases ($H_2$, $H_2S$, $NH_3$, and $C_1$-$C_4$), naphtha (fraction that boils at a temperature below 150° C.), kerosene (fraction that boils between 150° C. and 250° C.), and at least one portion of the diesel (fraction that boils between 250° C. and 375° C.). The light fraction may then be sent at least partly to a fractionating unit (not represented in FIG. 2) where the light gases are extracted from said light fraction, for example by passing through a flash drum. The gaseous hydrogen thus recovered, which can have been sent to a purification and compression equipment, may advantageously be recycled into the hydroconversion step (d). The recovered gaseous hydrogen can also be used in other equipment of the refinery.

The separation section 250 comprises any separation means known to a person skilled in the art. It can comprise one or more flash drums arranged in series, and/or one or more steam- and/or hydrogen-stripping columns, and/or an atmospheric distillation column, and/or a vacuum distillation column, and is preferably constituted by a single flash drum, commonly known as a "hot separator".

The step of fractionating, separating a portion or all of the hydroconverted liquid effluent from the second hydroconversion step to produce at least two fractions including the at least one heavy liquid cut 207 that boils predominantly at a temperature above 350° C., preferably above 500° C. and preferably above 540° C., is carried out in the fractionation section 270 comprising any separation means known to a person skilled in the art. The other cut(s) 206 are light and intermediate cut(s). The heavy liquid cut 207 contains a fraction that boils at a temperature above 540° C., referred to as vacuum residue (which is the unconverted fraction). It may contain a portion of the diesel fraction that boils between 250° C. and 375° C. and a fraction that boils between 375° C. and 540° C. referred to as vacuum distillate.

The fractionation section 270 can comprise one or more flash drums arranged in series, and/or one or more steam and/or hydrogen-stripping columns, and/or an atmospheric distillation column, and/or a vacuum distillation column, and is preferably constituted by a set of several flash drums in series and atmospheric and vacuum distillation columns.

Where it is desired to recycle a part of the heavy resid fraction (e.g. part of the heavy liquid cut 207, and/or part of the residual asphalt 209, or part of DAO 208) back through the hydroconversion system (e.g. for example in slurry bed reactor 240 or upstream) it may be advantageous to leave the colloidal or molecular catalyst within the resid, and/or residual asphalt fraction. A purging on the recycled stream can be carried out, in general for preventing some compounds from accumulating at excessive levels.

The present invention also relates to a slurry bed system 200 configured for hydroconverting the heavy oil feedstock 101 as detailed above. Numerical references mentioned below relate to FIG. 2, which illustrates schematically an example of a slurry bed hydroconversion system according to the invention. Said system 200 comprises:

- the first conditioner mixer 210 configured to prepare the first conditioned heavy oil feedstock 103 by mixing said heavy oil feedstock 101 with the organic additive 102 comprising at least one carboxylic acid function and/or at least one ester function and/or an acid anhydride function;

the second conditioner mixer 220 configured to prepare the second conditioned heavy oil feedstock 105 by mixing a catalyst precursor composition 104 with said first conditioned heavy oil feedstock 103;

the at least one preheating device 230 configured to heat the second conditioned feedstock 105;

the at least one slurry bed reactor 240 configured to comprise:

a liquid hydrocarbon phase that includes said second heated conditioned heavy oil feedstock 106 containing the colloidal or molecular catalyst dispersed therein;

and a gaseous phase comprising hydrogen.

Said at least one slurry bed reactor 240 is configured to operate in the presence of hydrogen and at hydroconversion conditions in order to cause thermal cracking of hydrocarbons in said second conditioned heavy oil feedstock to provide an upgraded material 107.

Said at least one preheating device 230 and/or said at least one slurry bed reactor 240 are also configured to form the colloidal or molecular catalyst within said second conditioned heavy oil feedstock.

Details on each apparatus/device/section used in the slurry bed system have already been given above in relation to the process and are not repeated.

EXAMPLE

The following example illustrates, without limiting the scope of the invention, some of the performance qualities of the process and system according to the invention, in particular the reduced fouling of equipment, in comparison with a process and system according to the prior art.

The example is based on a test using an analytical device, called Alcor Hot Liquid Process Simulator, or HLPS, from Alcor company, simulating the fouling effect of atmospheric residues (AR) in heat exchangers. The AR is pumped through a heater tube (laminar flow tube-in-shell heat exchanger) under controlled conditions and fouling deposits are formed on the heater tube. The temperature of the AR which exits the heat exchanger is related to the effect of the deposits on the efficiency of the heat exchanger. The decrease in AR liquid outlet temperature from its initial maximum value is called Delta T and is correlated to the deposit quantity. The higher the decreasing of Delta T, the higher the fouling and the deposit quantity.

The HLPS test can be used to evaluate the fouling tendency of different ARs by comparing the decreasing slope of the AR liquid outlet temperature obtained under identical test conditions. The effectiveness of an organic additive can also be determined by comparing test results from a neat sample (without an organic additive) to the sample blended with the organic additive.

Three samples are tested: sample 1 is a blend of a heavy oil feedstock and a molecular or colloidal catalyst according to the prior art, and samples 2 and 3 are blends according to the invention of a heavy oil feedstock with an organic additive, in addition to the same molecular or colloidal catalyst.

The heavy oil feedstocks are used ("Feed"), is an atmospheric residue (AR) whose main composition and properties are given table 1 below.

TABLE 1

| | Standardized method | Unit | Feed | VGO (CPC diluent) |
|---|---|---|---|---|
| Density | NF EN ISO 12185 | | 0.959 | 0.8677 |
| IBP-350° C. | ASTM D1160 | wt % | 21 | 2.7 |
| 350-540° C. | ASTM D1160 | wt % | 35 | 95.5 |
| 540° C.+ | ASTM D1160 | wt % | 44 | 1.8 |
| C | ASTM D5291 | wt % | 84.5 | 86.5 |
| H | ASTM D5291 | wt % | 11.4 | 13.71 |
| N | ASTM D5291 | wt % | 0.3 | 0.0037 |
| S | NF ISO 8754 | wt % | 3.81 | 0.074 |
| Ni | ASTM D7260 | wt ppm | 25 | <2 |
| V | ASTM D7260 | wt ppm | 78 | <2 |
| K | ASTM D7260 | wt ppm | 2 | <1 |
| Na | ASTM D7260 | wt ppm | 196 | <1 |
| Ca | ASTM D7260 | wt ppm | <1 | <1 |
| P | ASTM D7260 | wt ppm | <5 | <5 |
| Si | ASTM D7260 | wt ppm | <1 | <1 |
| Fe | ASTM D7260 | wt ppm | 3 | 6 |
| Ti | ASTM D7260 | wt ppm | 79 | <1 |
| Asphaltenes $C_5$ | UOP99 - 07 | wt % | 10.6 | 0.2 |
| Asphaltenes $C_7$ | NF T60-115 | wt % | 4.7 | 0.05 |
| Conradson Carbon | NF EN ISO 10370 | wt % | 11.3 | 0.2 |

Sample 1: sample 1 is a blend of the Feed (AR) and a catalyst precursor composition (CPC) being molybdenum 2-ethylhexanoate, the molybdenum 2-ethylhexanoate being diluted in a vacuum gas oil (VGO) to form a solution of CPC.

The composition of the VGO is given in table 1 above.

The CPC solution is obtained by mixing the molybdenum 2-ethylhexanoate with the VGO, at a temperature of 70° C. and for a time period of 30 minutes. The molybdenum 2-ethylhexanoate content in the solution of CPC containing to VGO is 3500 wt. ppm.

The solution of CPC is then mixed with the Feed (AR) at a temperature of 70° C. and for a time period of 30 minutes.

The content of Mo in sample 1 is of 315 wt. ppm (see table 2 below)

Sample 2: sample 2 is a blend of the Feed (AR) with the same CPC solution (molybdenum 2-ethylhexanoate diluted with the VGO) as in sample 1, and with an organic additive being 2-Ethylhexanoic Acid (2EHA). The CAS number of 2EHA is 149-57-5.

The Feed is first mixed with the organic additive 2EHA, for a time period of 30 minutes, and at temperature of 70° C., to form the first conditioned feedstock.

Then, the first conditioned feedstock is mixed with the solution of CPC, obtained as detailed for sample 1, at a temperature of 70° C. and for a time period of 30 minutes, to form a second conditioned feedstock which is sample 2.

The content of Mo in sample 2 is of 315 wt. ppm (see table 2 below).

The concentration of organic additive 2EHA is 5827 wt. ppm (see table 2 below).

The molar ratio of 2EHA/Mo=12.3.

Sample 3: sample 3 is a blend of the Feed (AR) with the same CPC solution (molybdenum 2-ethylhexanoate diluted with the VGO) as in samples 1 and 2, and with an organic additive being Ethyl octanoate (EO). The CAS number of EO is 106-32-1.

The Feed is first mixed with the organic additive EO, for a time period of 30 minutes, and a temperature of 70° C. to form a first conditioned feedstock.

Then, the first conditioned feedstock is mixed with the solution of CPC, obtained as detailed for sample 1, at a temperature of 70° C. and for a time period of 30 minutes, to form a second conditioned feedstock which is sample 3.

The content of Mo in sample 3 is of 315 wt. ppm (see table 2 below).

The concentration of organic additive EO is 7340 wt. ppm (see table 2 below).

The molar ratio of EO/Mo=13.0.

TABLE 2

| | Sample 1: Feed + CPC in VGO | Sample 2: [Feed + 2EHA] + CPC in VGO | Sample 3: [Feed + EO] + CPC in VGO |
|---|---|---|---|
| Mo (wt. ppm) | 315 | 315 | 315 |
| Acid organic additive 2EHA (wt. ppm) | — | 5827 | — |
| Ester organic additive EO (wt. ppm) | — | — | 7340 |

The Mo content in the samples was determined according to ASTM D7260. The acid and ester organic additive content was determined by weighing.

The HLPS test conditions are given in table 3 below.

TABLE 3

| Test mode | Single pass |
|---|---|
| Feed temperature (° C.) | 90 |
| Flow rate (mL/min) | 1 |
| Oil in temperature (° C.) | 100 |
| Tube temperature (° C.) | 450 |
| Tube material | 1018 steel |
| Gauge pressure (Mpa) | 3.4 |

Figure 3:
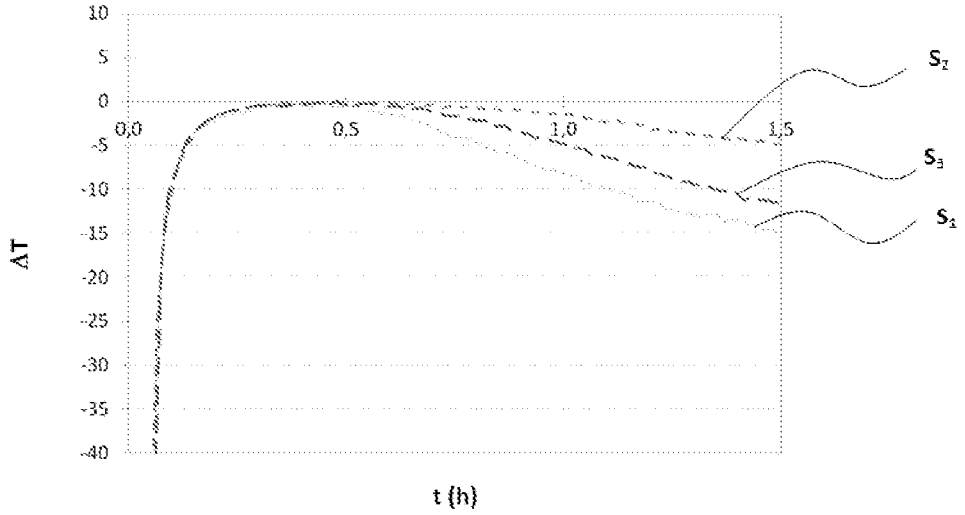
FIG. 3 is a graph showing the fouling tendency of examples of conditioned oil feedstocks as prepared in the slurry bed hydroconversion process according to the invention and according to prior art.

The results of the test for the different samples ($S_1$ for sample 1, $S_2$ for sample 2, $S_3$ for sample 3) are shown in the graph of FIG. 3. X-axis represents time in hours, and Y-axis represents the difference in temperature ΔT between the temperature of the oil blend (sample) exiting the tube at a time t$[T_{Oil\ out}]_t$ and the maximum temperature of the oil blend (sample) exiting the tube $[T_{Oil\ out}]_{Max}$: $\Delta T=[T_{Oil\ out}]_t-[T_{Oil\ out}]_{Max}$.

The results show that the sample 1 has a strong fouling tendency since its Delta T falls quickly. Samples 2 and 3 which contain an organic additive, e.g. 2EHA or EO, according to the invention have a lower Delta T than sample 1, showing that the fouling behavior is significantly reduced under the action of said organic additive.

The invention claimed is:

1. A process for the hydroconversion of a heavy oil feedstock (101) containing a fraction of at least 50% by weight having a boiling point of at least 300° C., and containing metals and asphaltenes, comprising:

(a) preparing a first conditioned heavy oil feedstock (103) by blending said heavy oil feedstock (101) with an organic chemical compound (102) comprising at least one carboxylic acid function and/or at least one ester function and/or an acid anhydride function;

(b) preparing a second conditioned heavy oil feedstock (105) by mixing a catalyst precursor composition (104) comprising molybdenum 2-ethylhexanoate, molybdenum naphthanate, vanadium naphthanate, vanadium octoate, molybdenum hexacarbonyl, vanadium hexacarbonyl, or iron pentacarbonyl with the first conditioned heavy oil feedstock (103) from (a) in a manner so that a colloidal or molecular catalyst is formed when it reacts with sulfur;

(c) heating the second conditioned heavy oil feedstock from (b) in at least one preheating device;

(d) introducing said heated second conditioned heavy oil feedstock (106) from (c) into at least one slurry bed reactor and operating said slurry bed reactor in the presence of hydrogen and at hydroconversion conditions to produce an upgraded material (107), and wherein the colloidal or molecular catalyst is formed in situ within the second conditioned heavy oil feedstock at (c) and/or at (d).

2. A process as claimed in claim 1, wherein (a) comprises mixing said organic chemical compound (102) and said heavy oil feedstock (101) in a dedicated vessel of an active mixing device.

3. A process as claimed in claim 1, wherein (a) comprises injecting said organic chemical compound (102) into a conduit conveying said heavy oil feedstock (101) toward the slurry bed reactor.

4. A process as claimed in claim 1, wherein (a) is carried out at a temperature between room temperature and 300° C., and the residence time of the organic chemical compound with the heavy oil feedstock before (b) is between 1 second and 10 hours.

5. A process as claimed in claim 1, wherein the organic chemical compound (102) is selected from 2-ethylhexanoic acid, naphthenic acid, caprylic acid, adipic acid, pimelic acid, suberic acid, azelaic acid, and sebacic acid, ethyl octanoate, ethyl 2-ethylhexanoate, 2-ethylhexyl 2-ethylhexanoate, benzyl 2-ethylhexanoate, diethyl adipate, dimethyl adipate, bis(2-ethylhexyl) adipate, dimethyl pimelate, dimethyl suberate, monomethyl suberate, hexanoic anhydride, caprylic anhydride, and mixtures thereof.

6. A process as claimed in claim 5, wherein the organic chemical compound (102) comprises 2-ethylhexanoic acid.

7. A process as claimed in claim 5, wherein the organic chemical compound (102) comprises ethyl octanoate or 2-ethylhexyl 2-ethylhexanoate.

8. A process as claimed in claim 1, wherein the molar ratio between said organic chemical compound (102) added at a) and the active metal(s) of the catalyst precursor composition (104) added at (b) in said second conditioned heavy oil feedstock is between 0.1:1 and 20:1.

9. A process as claimed in claim 1, wherein the colloidal or molecular catalyst comprises molybdenum disulfide.

10. A process as claimed in claim 1, wherein (b) comprises: (b1) pre-mixing the catalyst precursor composition with a hydrocarbon oil diluent below a temperature at which a substantial part of the catalyst precursor composition begins to undergo thermal decomposition, to form a diluted precursor mixture; and (b2) mixing said diluted precursor mixture with the first conditioned heavy oil feedstock.

11. A process as claimed in claim 10, wherein (b1) is carried out at a temperature between room temperature and 300° C. and for a period of time from 1 second to 30 minutes, and (b2) is carried out at a temperature between room temperature and 300° C. and for a period of time from 1 second to 30 minutes.

12. A process as claimed in claim 1, wherein (c) comprises heating at a temperature between 280° C. and 450° C.

13. A process as claimed in claim 1, wherein the heavy oil feedstock (101) comprises at least one of the following feedstocks: heavy crude oil, oil sand bitumen, atmospheric tower bottoms, vacuum tower bottoms, resid, visbreaker bottoms, coal tar, heavy oil from oil shale, liquefied coal, heavy bio oils, and heavy oils comprising plastic waste and/or a plastic pyrolysis oil.

14. A process as claimed in claim 1, wherein the heavy oil feedstock (101) has a sulfur at a content of greater than 0.5% by weight, a Conradson carbon residue of at least 0.5% by weight, $C_7$ asphaltenes at a content of greater than 1% by weight, transition and/or post-transition and/or metalloid metals at a content of greater than 2 ppm by weight, and alkali and/or alkaline earth metals at a content of greater than 2 ppm by weight.

15. A process as claimed in claim 1, wherein hydroconversion (d) is carried out under an absolute pressure of between 2 MPa and 38 MPa, at a temperature of between 300° C. and 550° C., at an liquid hourly space velocity LHSV relative to the volume of each slurry bed reactor of between 0.05 $h^{-1}$ and 10 $h^{-1}$ and under an amount of hydrogen mixed with the feedstock entering slurry bed reactor of between 50 and 5000 normal cubic meters ($Nm^3$) per cubic meter ($m^3$) of feedstock.

16. A process as claimed claim 1, wherein the concentration of the catalyst metal in the second conditioned oil feedstock (105) is in a range of 10 ppm to 10000 ppm by weight of the heavy oil feedstock.

17. A process as claimed in claim 1, wherein (a) is carried out at a temperature between 70° C. and 200° C., and the residence time of the organic chemical compound with the heavy oil feedstock before (b) is between 1 second and 10 hours.

18. A process as claimed in claim 1, wherein (c) comprises heating at a temperature between 300° C. and 400° C.

19. A process as claimed in claim 1, wherein the catalyst precursor composition is molybdenum 2-ethylhexanoate.

20. A process as claimed claim 16, wherein the catalyst metal is molybdenum.

* * * * *